US005919059A

United States Patent [19]

Bozzer et al.

[11] Patent Number: 5,919,059

[45] Date of Patent: Jul. 6, 1999

[54] COAXIAL SPLICE CONNECTOR

[75] Inventors: Dieter Bozzer, Bex; Blaise Rithener, Vevey; Lionel Thomas, Bramois, all of Switzerland; Patrick Duquerroy, Froschhausen, Germany

[73] Assignee: The Whitaker Corporation, Wilmington, Del.

[21] Appl. No.: 08/972,567

[22] Filed: Nov. 18, 1997

[51] Int. Cl.[6] ..... H01R 4/24

[52] U.S. Cl. ..... 439/394

[58] Field of Search ..... 439/394, 402, 439/421, 424; 174/84 R

[56] References Cited

U.S. PATENT DOCUMENTS 4,653,829 3/1987 LaMont ..... 439/409

5,019,674 5/1991 Greene ..... 174/84 R 5,205,761 4/1993 Nilsson ..... 439/578

OTHER PUBLICATIONS

British Search Report.

*Primary Examiner*—Neil Abrams

*Assistant Examiner*—Barry M. L. Standig

*Attorney, Agent, or Firm*—Driscoll Nina

[57] ABSTRACT

A coaxial splicing connector has an inner contact section and an outer conductor stamped and formed from sheet metal and having crimping arms that engage hinged stuffer members for stuffing the coaxial connector inner conductors into contact slots. Insulation piercing blades extend inward from the outer conductor and pierce through the coaxial cable outer conductor for electrical contact therewith during the crimping operation. Rapid splicing connection between coaxial connectors is thus achieved.

10 Claims, 3 Drawing Sheets

2
4
5
6
8
10
12
14
16
20
22
23
29
31
32
34
38
40
44
45
46
48
54
55
60
62
70
72
74

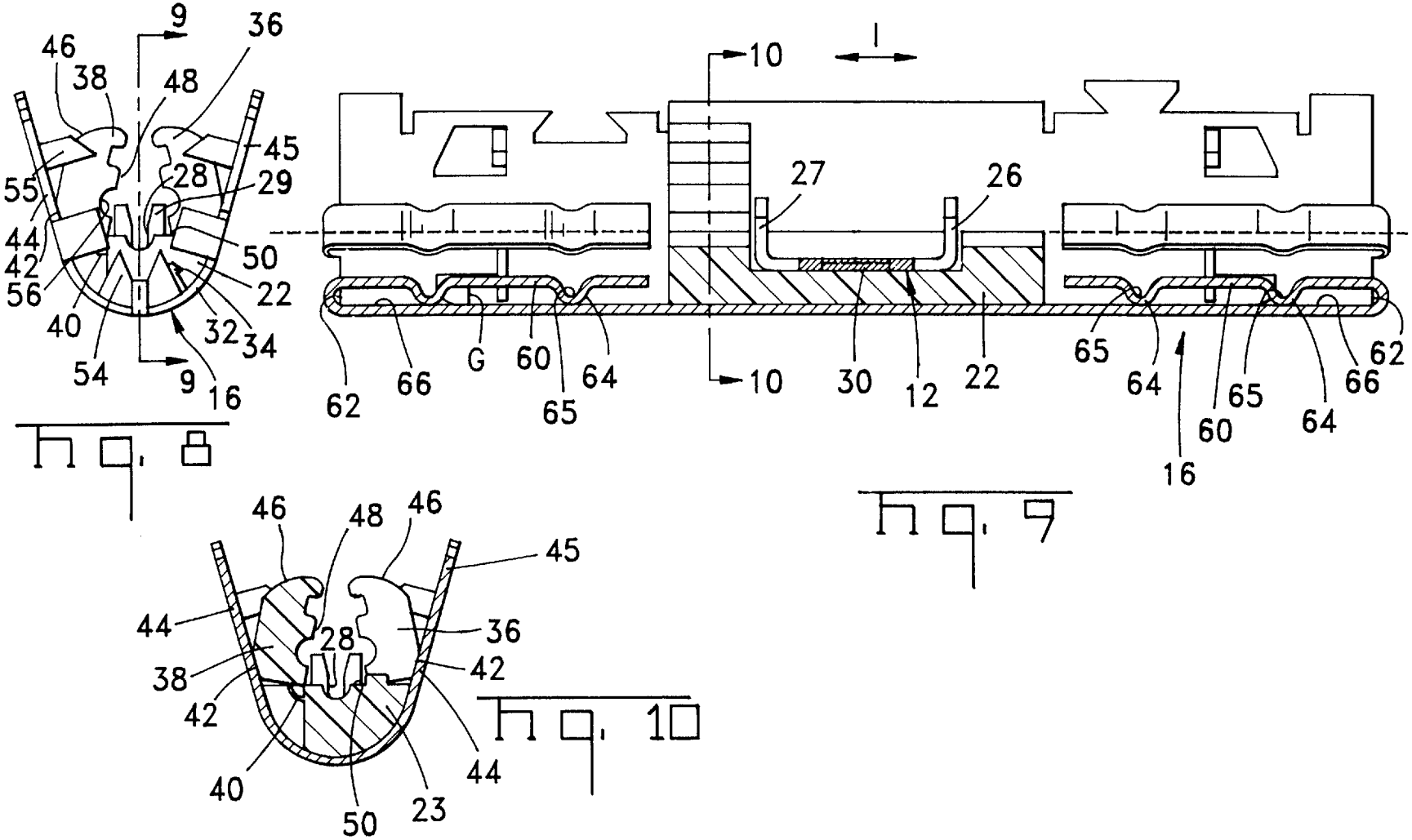
62
66
64
65
60
16
64
65
26
22
12
30
27
10
10
64
65
60
G
66
62
36
45
29
50
22
34
32
16
9
48
28
9
38
46
55
44
42
56
40
54
45
36
42
44
46
23
48
28
50
46
40
44
38
42

COAXIAL SPLICE CONNECTOR

BACKGROUND OF THE INVENTION

1. Field of the Invention

This invention relates to a connector for connection to coaxial cables.

2. Description of the Prior Art

Electrical coaxial cables are commonly used for transmission of high speed electrical signals for data transmission. The effectiveness of coaxial cables with respect to the amount of electromagnetic noise radiated, and range of an interconnection system depends, inter alia, on the quality of the interconnection between a coaxial cable and another coaxial cable or electronic device. In particular, good electrical continuity of the outer conductor is required. In view of these requirements and the coaxial structure of the cable, interconnection systems for coaxial cables are often costly, comprising components machined from solid metal, or time consuming to assemble. It would be desirable to provide a coaxial interconnection assembly, particularly for splicing coaxial cables, that is cost-effective to produce, and simple to assemble, whilst ensuring a high quality interconnection.

SUMMARY OF THE INVENTION

It is thus an object of this invention to provide a coaxial connector for coaxial cables that is cost-effective to produce and enables rapid connection termination. It would be further advantageous to provide a particularly effective strain relief retention of a cable to a coaxial connector assembly. It would also be advantageous to provide a connector assembly that enables provision of a compact splicing connection between coaxial cables.

Objects of this invention have been achieved by providing a coaxial connector for connection to a coaxial cable having an inner conductor concentrically surrounded by an outer conductor, the connector comprising an outer conductor section with an outer contact section for contacting the outer conductor, and an inner contact section for contacting the inner conductor, the inner and outer contact section being separated by a dielectric, wherein the dielectric comprises a movable stuffer member for engaging and stuffing the inner conductor into a contact slot of the inner contact section, the stuffer member engageable by a crimp arm of the outer conductor section during termination for effecting the stuffing movement of the stuffer member.

Advantageously therefore, a cost effective connector assembly for coaxial cables is provided. In particular, termination of a cable to the connector assembly is easily and rapidly effected.

Further advantageous aspects of this invention will be apparent from the description, drawings and claims.

BRIEF DESCRIPTION OF THE DRAWINGS

FIG. 8 is an end view of the connector assembly according to FIG. 1 prior to termination to coaxial cables;

FIG. 9 is a cross-sectional view through line 9/9 of FIG. 8; and

FIG. 10 is a cross-sectional view through line 10/10 of FIG. 9.

DETAILED DESCRIPTION OF THE PREFERRED EMBODIMENT

Figures 1, 2, 3, 4, 5:
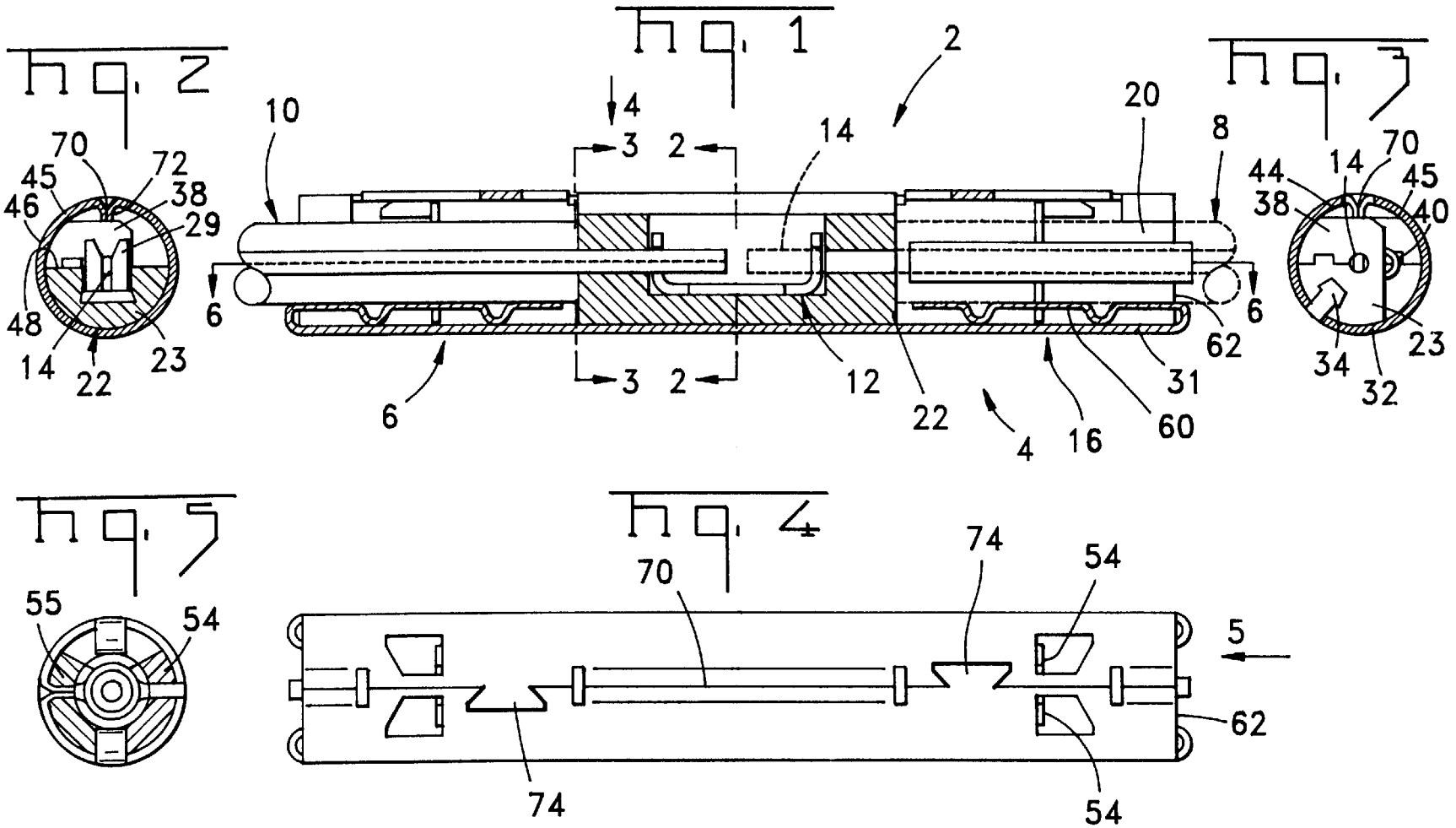
FIG. 1 is a longitudinal cross-sectional view through a connector assembly for connecting coaxial cables, according to this invention.
FIG. 2 is a cross-sectional view through line 2/2 of FIG. 1.
FIG. 3 is a cross-sectional view through line 3/3 of FIG. 1.
FIG. 4 is a view in the direction of arrow 4 of FIG. 1.
FIG. 5 is a view in the direction of arrow 5 of FIG. 4.

Referring to the figures, particularly FIG. 1, a connector assembly 2 comprises a first connection section 4 and a second connection section 6. The connection sections 4,6 are each for terminating a coaxial cable 8,10 respectively, the connection section 4,6 being substantially identical and forming a splicing connection for interconnecting the pair of cables 10,8. It would however be conceivable to provide only one connection section 4 that terminates a coaxial cable, the other connection section being interconnected to an electronic device, electrical plug or other apparatus.

Each connection section 4,6 comprises (see FIG. 6) an inner contact section 12 for contacting an inner conductor 14 of the coaxial cable, an outer conductor section 16 comprising an outer contact section 18 for contacting the outer conductor 20 of the coaxial cable. The outer conductor 20 is a thin layer concentrically surrounding the inner conductor 14 and separated therefrom by a dielectric. The coaxial cable may also be a piezoelectric cable, whereby the inner and outer conductors are separated by a piezoelectric material. The connector assembly further comprises a dielectric 22 separating and supporting the inner contact section 12 from the outer conductor section 16. The connector further comprises a strain relief section 24 for gripping the outer layer of the coaxial cable.

Figure 7:
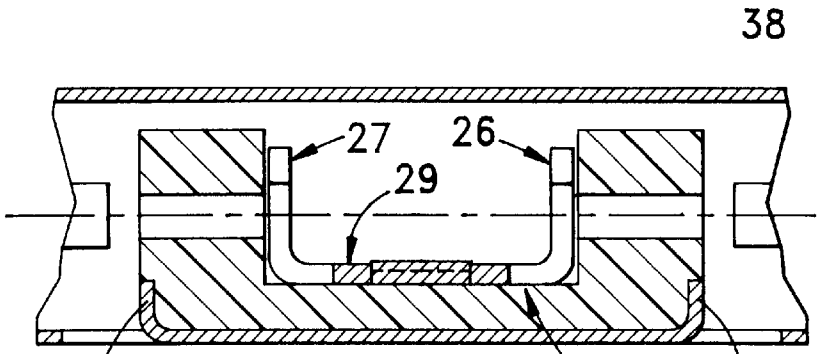
FIG. 7 is a more detailed view of a central portion of FIG. 1 with the coaxial connectors removed.

As best seen in FIGS. 7, 8 and 9 the inner contact section 12 comprises a contact blade 26 having a contact slot 28 for receiving the cable inner conductor 14 between substantially parallel edges of the contact slot 28. Sections 29 of the blade resiliently squeeze the cable inner conductor for good electrical contact therewith. The inner contact section 12 can be stamped and formed from sheet metal into a substantially U-shaped profile in the longitudinal cross-section, as shown in FIG. 9, for interconnecting the inner contact blades 26,27 of the splicing assembly. The inner connection section 12 is fastened to the dielectric 22 either by overmoulding or by use of conventional retention barbs or other retention means stamped from the base wall 29 of the connection section and engaging in the dielectric, for example.

Prior to termination to a coaxial cable, the outer conductor section 16 as best seen in FIGS. 8, 9, 10 has a substantially U or V-shaped profile extending in the longitudinal direction L. Prior to termination, the dielectric 22 is seated in the closed base portion 32 of an outer wall 31 of the outer conductor section. The outer conductor section is in this embodiment also stamped and formed from sheet metal. A retention tab 34 stamped out of the outer wall 31 projects from the base portion 32 for engagement with the dielectric for positioning and retaining the dielectric and inner contact section 12 within the outer wall 31 as shown in FIGS. 7 and 8. The dielectric 22 further comprises a stuffer member 36,38 for each of the inner contact blades 26,27 integrally moulded with the base portion 23 of the dielectric as shown in FIG. 10 by the hinge 40. The stuffer members 36,38 are attached to the base portion 23 on opposing sides of the contact slot 28 of the inner contacts.

Referring to FIGS. 8 and 10, the stuffer member comprises a rounded or angled outer corner 42 proximate the hinge portion 40 for engaging a side crimping arm 44 of the outer conductor 16. The stuffer member further comprises a remote rounded abutment corner 46 for engaging the crimping arm 45 on the opposed side of the connector. The crimp arm 45 opposed to the stuffer engages the rounded corner 46 during deformation until the final clamp position as shown in FIG. 2 where a clamping surface 48 of the stuffer member abuts the dielectric upper surface 50. The stuffer member serves to stuff the cable center conductor 14 into the corresponding inner contact slot 28. The abutment stuffer surface 48 of the stuffer comprises a wire locating recess 56 that positions and supports the coaxial center conductor during stuffing operation.

The outer conductor section is provided with a plurality of insulation piercing blades 54 disposed around the periphery for piercing through the outer insulation of the cables 8,10 and contacting the outer concentric conductor of the cable. As shown in FIG. 5 the outer conductor piercing blades 54 are disposed in a plurality of positions around the periphery of the cable. By virtue of provision of the stuffer members, termination of the center conductor and crimping of the outer conductor to the splice contact occurs in a single movement.

As best seen in FIG. 2 a seam 70 of the outer conductor 16 resulting from the crimping together of the crimp arms 44,45 has inwardly directed ends 72 that abut the stuffer members for securely pressing them against the dielectric 22. As seen in FIG. 4 dove tail tabs 74 engaging in corresponding cutouts of the opposed crimp arms serve to securely block the outer conductor in the crimped position.

Figure 6:
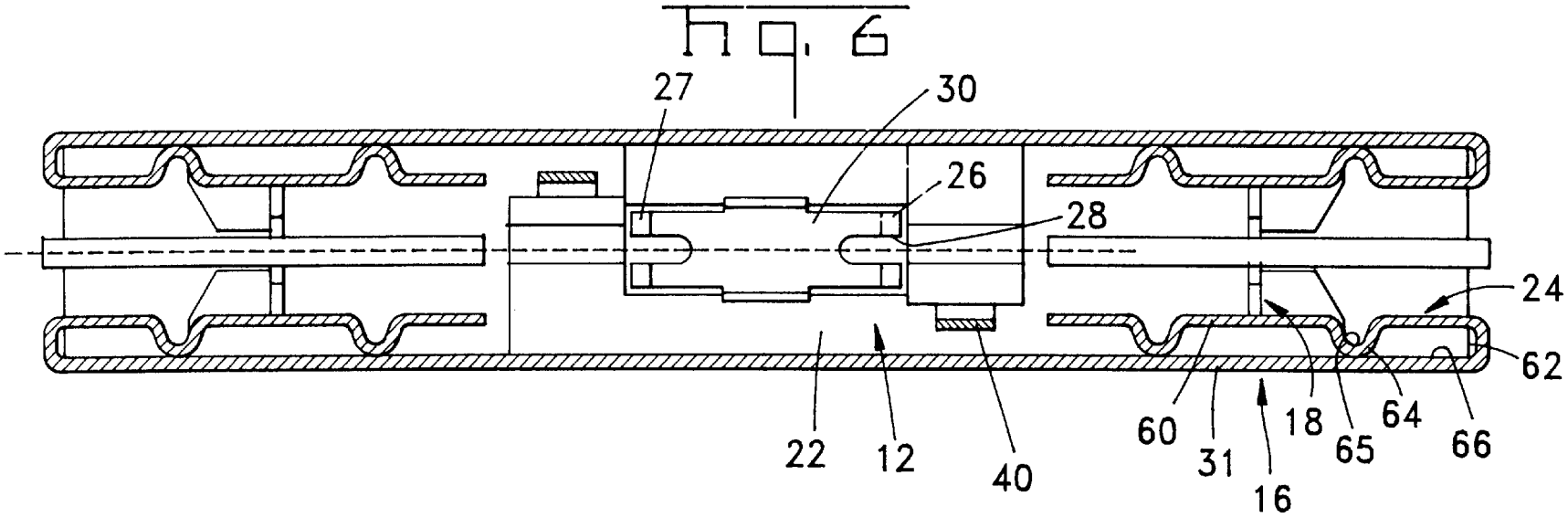
FIG. 6 is a longitudinal cross-sectional view through line 6/6 of FIG. 1 with the coaxial cables removed.

Referring to FIGS. 6 and 9, the outer conductor is further provided with cable support walls 60 in the form of elongate extensions reversely folded from the outer conductor section 16 at ends 62 thereinto. Protrusions 64 stamped from the extension 60 abut an inner surface 66 of the outer conductor. The protrusions 64 form recesses 65 facing the cable for receiving a bulge of outer insulating layer during compression of the outer conductor during the crimping process. The bulge of insulating layer engaging in the recesses 65 serves to provide effective stain relief means of the cable to the outer conductor. The protrusions 64 also serve to space the extensions from the outer wall by a gap G such that a certain resilience of the strain relief structure is provided. The latter enables a more secure and reliable strain relief means, and in addition reduces risk of damage to the cable at the outlet end 62. A plurality of the strain relief walls 60 are positioned around the periphery.

We claim:

1. A coaxial connector for connection to a coaxial cable having an inner conductor concentrically surrounded by an outer conductor, the connector comprising an outer conductor section with an outer contact section for contacting the outer conductor, and an inner contact section for contacting an inner conductor, the inner and outer contact section being separated by a dielectric, wherein the dielectric comprises a movable stuffer member for engaging and stuffing the inner conductor into a contact slot of the inner contact section, the stuffer member engageable by a crimp arm of the outer conductor section during termination for effecting the stuffing movement of the stuffer member.

2. The connector of claim 1 wherein the stuffer member is pivotly attached to a base portion of the dielectric.

3. The connector of claim 1 wherein the outer conductor section has a substantially U- or V-shaped profile extending in a longitudinal direction parallel to the cable when terminated thereto, the profile formed by a base wall and a pair of the crimping arms extending therefrom, the crimping arms being deformable together around the coaxial cable during termination.

4. The connector of claim 3 wherein the dielectric base portion is securely attached to the outer conductor section base wall.

5. The connector of claim 1 wherein the outer conductor section comprises one or more insulation piercing blades for contacting the cable outer conductor.

6. The connector of claim 5 wherein a plurality of the insulation piercing blades are disposed around the cable when terminated thereto, the blades being stamped inwardly from outer wall of the outer conductor section that receives the cable therein.

7. The connector of claim 1 wherein the outer conductor section comprises an outer wall forming a cable receiving cavity for receiving the cable, the outer wall extending to a cable outlet end, the outer conductor section further comprising one or more strain relief members in the form of elongate extensions inwardly folded from the outlet end into the cable receiving cavity, the extensions having a profiled surface for gripping the cable when terminated thereto.

8. The connector of claim 7 wherein the profiled surface comprises one or more recesses formed by stamping a bulge in the extensions, the bulges resting against an inner surface of the outer wall.

9. The connector of claim 1 wherein the connector is a splicing connector for interconnecting two coaxial cables, the connector having a pair of the inner and outer conductor sections in longitudinal alignment.

10. The connector of claim 1 wherein a pair of the stuffer members are provided, one for each inner contact, each stuffer member being positioned on a side opposite the other with respect to the contact sections, and each stuffer member engageable by a different one of a pair of the crimp arms.

* * * * *